US006015371A

United States Patent [19]

Davitt

[11] Patent Number: 6,015,371

[45] Date of Patent: Jan. 18, 2000

[54] EXERCISE MECHANISM

[76] Inventor: Christopher Davitt, 155 Old Orchard Rd., Buxton, Me. 04072

[21] Appl. No.: 09/220,840

[22] Filed: Dec. 24, 1998

[51] Int. Cl.[7] ..... A63B 21/02

[52] U.S. Cl. ..... 482/129; 904/121

[58] Field of Search ..... 482/121–130, 482/904, 92, 111, 112, 148

[56] References Cited

U.S. PATENT DOCUMENTS

| | | | |
|---|---|---|---|
| 655,671 | 8/1900 | Grookes et al. | 482/129 |
| 689,418 | 12/1901 | Ryan | 482/129 |
| 705,266 | 7/1902 | Mattson | 482/129 |
| 754,992 | 3/1904 | Grabner | 482/129 |
| 5,029,850 | 7/1991 | Van Straaten | 482/904 |
| 5,221,240 | 6/1993 | Mann et al. | 482/40 |
| 5,385,525 | 1/1995 | Davis | 482/121 |
| 5,601,518 | 2/1997 | Weintraub | 482/129 |
| 5,820,529 | 10/1998 | Weintraub | 482/92 |

*Primary Examiner*—Jerome Donnelly
*Attorney, Agent, or Firm*—Frederick R. Cantor, Esq.

[57] ABSTRACT

An exercise machine includes an anchorage adapted to fit on the upper edge of a room door, a lower anchorage adapted to fit on the lower edge of the door, and an operating mechanism trained between the two anchorages. The mechanism includes an elastic resistance device and a variable length connector between the resistance device and a variable length connector between the resistance device and one of the anchorages. A flexible tension element extends around a pulley system within the variable length connector and out of the connector to an external handgrip. The handgrip can be pulled to stress the elastic resistance device.

13 Claims, 6 Drawing Sheets

FIG 16

EXERCISE MECHANISM

BACKGROUND OF THE PRESENT INVENTION

SUMMARY OF THE PRESENT INVENTION

This invention relates to an exercise mechanism, and particularly an exercise mechanism adapted for detachable mounting on a room door, whereby the mounting expense is minimized.

The invention is concerned with a type of exercise mechanism especially designed for exercising the persons arm muscles, and/or muscles. With the exercise mechanism located in a generally vertical position on one face of a room door, the person grasps a handgrip that is attached to a flexible tension element extending from the mechanism. The handgrip is pulled up or down (depending on the type of exercise routine being performed) so that the tension element is drawn out of the mechanism to exert a tension force on an elastic resistance means located with the exercise mechanism.

The elastic resistance means exerts a resilient reaction force on the tension element that effectively exercises the person's arm and/or back muscles. As the person relaxes the pulling force on the handgrip, the elastic resistance means draws the tension element back into the exercise mechanism, whereby the exercise motion can be repeated on a cyclic basis.

One advantage of the invention is that the exercise mechanism is mounted in a vertical position on the room door, such that the person can be in a standing position or sitting position while performing the exercise. In each position, different muscles are exercised.

Another advantage of the invention is that the exercise mechanism can have different orientations on the room door. In one orientation the mechanism is located so that the person is required to exert a downward pulling force on the handgrip. In another orientation, the mechanism is located so that the person is required to exert an upward pulling force on the handgrip. With the different orientations of the mechanism, the person exercises different muscles. This feature increases the versatility and usefulness of the invention mechanism.

In preferred practice of the invention, the mechanism components are detachably connected together, so that the components can be disassembled easily (without tools) and formed into a compact package for compact storage and/or transport. In one form of the invention a fabric pouch structure is provided for containing the mechanism components in the disassembled stage; the pouch comprises multiple pockets adapted to house individual components, whereby the pouch can be folded and rolled up into an easily-carried package.

The mechanism is designed so that each component is relatively light. When the disassembled components are put into the pouch the total weight of the pouch and contained components is relatively small (less than ten pounds), whereby the package can be easily carried from one place to another. The rolled-up pouch, with the exercise mechanism in the pouch pockets, can be stored in a very small space, e.g. on a shelf in a closet.

Further features of the invention will be apparent from the attached drawings and description of an illustrative embodiment of the invention.

In summary, and in accordance with the above discussion, the forgoing objectives are achieved in the following embodiment:

1. An exercise mechanism comprising:

first and second anchorages;

an elastic resistance means extending from said first anchorage;

a variable length connector means extending between said second anchorage and said elastic resistance means; and said variable length connector means comprising an elongated housing, a flexible tension element extending from said housing at a point near said second anchorage, and a handgrip carried by the external end of said tension element, whereby a manual pulling force on said handgrip reduces the length of said housing while applying an operating force to said elastic resistance means.

2. The exercise mechanism, as described in paragraph 1, wherein said variable length connector means comprises a pulley system located within said elongated housing, said flexible tension element being trained around said pulley system so that the tension element experiences an increase in its external length while the housing is experiencing a reduction in its length.

3. The exercise mechanism, as described in paragraph 2, wherein said pulley system has four pulleys.

4. The exercise mechanism, as described in paragraph 2, wherein said variable length housing comprises first and second telescoping tubes, said first tube being connected to said second anchorage; said second tube being connected to said elastic resistance means; said pulley system comprising two pulleys mounted on said first tube and two pulleys mounted on said second tube.

5. The exercise mechanism, as described in paragraph 2, wherein said variable length housing comprises first and second tubes telescoped one within the other; said first tube being connected to said second anchorage; said second tube being connected to said elastic resistance means; said pulley system comprising at least one pulley located within said first tube, and at least one pulley located within said second tube.

6. The exercise mechanism, as described in paragraph 1, wherein said first anchorage has a detachable connection with said elastic resistance means, and said second anchorage has a detachable connection with said variable length connector means; said variable length connector means having a detachable connection with said elastic resistance means, whereby the exercise mechanism can be broken down for easy transport and storage.

7. The exercise mechanism, as described in paragraph 1, wherein said elastic resistance means comprises at least one elongated elastomeric strap; each said elatromeric strap having an elongated main section and two end sections, each main section having a constant cross section, each end section being enlarged relative to the main section so that elastic deformation is confined to the elongated main section.

8. The exercise mechanism, as described in paragraph 7, wherein the main section of each elastomeric strap has a rectangular cross section.

9. The exercise mechanism, as described in paragraph 1, wherein said first anchorage comprises means for attachment to one edge of a door, and said second anchorage comprises means for attachment to another edge of a door, whereby the exercise mechanism is adapted to extend along one face of the door.

10. The exercise mechanism, as described in paragraph 1, wherein said first anchorage comprises a first channel adapted to fit on one edge of a door, and said second anchorage comprises a second channel adapted to fit on another edge of a door, whereby the exercise mechanism is adapted to extend along one face of the door.

11. An exercise mechanism comprising:

First and second anchorages; said first anchorage being adapted to fit on an upper edge of a room door; said second anchorage being adapted to fit on a lower edge of the room door;

an elastic resistance means connectable alternatively to said first anchorage or said second anchorage;

a variable length connector means extendable between said elastic resistance means and either one of said anchorages, depending on the location of said resistance means on the room door;

said variable length connector means comprising a tube assembly that includes two tubes slidably telescoped one within the other; a pulley system that includes a first set of pulleys located within one of said tubes, and a second set of pulleys located within the other tube;

a flexible tension element trained around the pulleys in said first and second pulley sets, said tension element extending out of one of the tubes; and a handgrip carried by the external end of said tension element, whereby a manual pulling force on said handgrip produces a decrease in the tube assembly length and an increase in the external length of the tension element.

12. The exercise mechanism, as described in paragraph 11, wherein the increase in the external length of the tension element is appreciably greater that the decrease in the tube assembly length, in accordance with the number of pulleys in the pulley system.

13. The exercise mechanism, as described in paragraph 11, wherein the external length of the tension element is adjustable when the tension element is in the non-tensioned state.

BRIEF DESCRIPTION OF THE DRAWINGS

FIG. 3 is taken on line 3—3 in FIG. 4.

DESCRIPTION OF THE PREFERRED EMBODIMENTS OF THE PRESENT INVENTION

Figure 1:
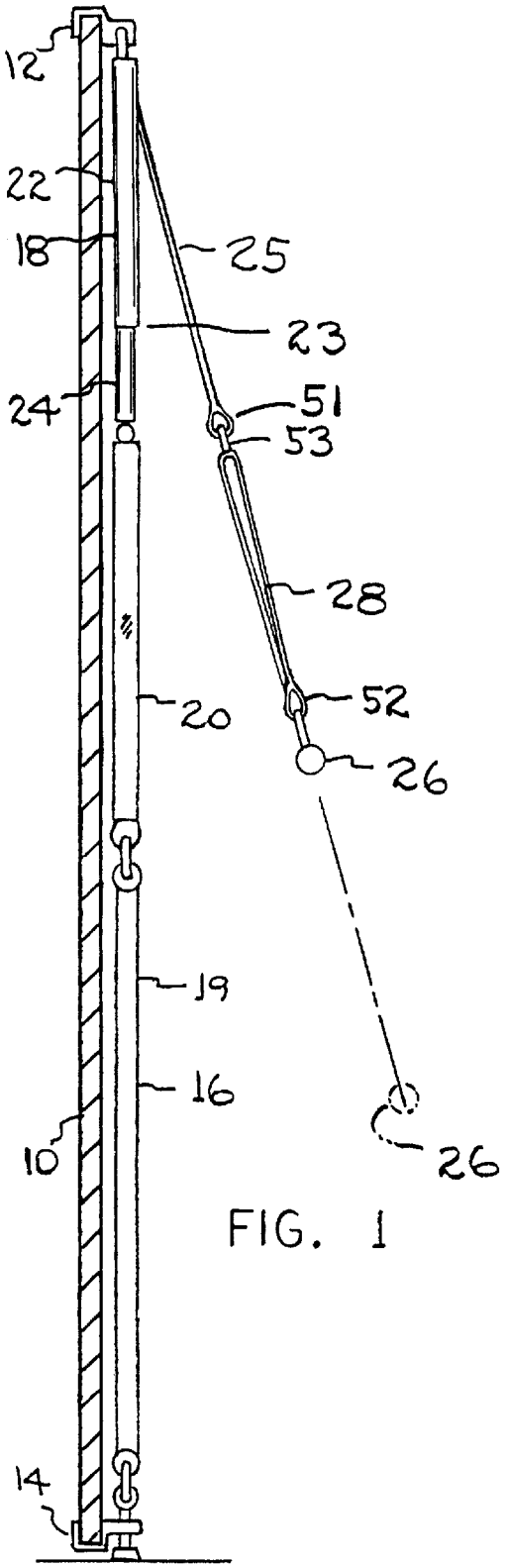
FIG. 1, shows an exercise mechanism of the present invention installed (mounted) on a conventional room door, e.g. a closet door or bathroom door, or bedroom door.

FIG. 1 shows an exercise mechanism of the present invention installed on a room door 10, whereby a person, standing or sitting in front of the door, can perform an exercise routine. The exercise mechanism comprises an anchorage 12 releasably attached to the upper edge of door 10, another anchorage 14 releasably attached to the lower edge of door 10, an elastic resistance means 16 attached to anchorage 12, and a variable length connector means 18 attached to anchorage 14. Elastic resistance means 16 comprises an elongated elastomeric strap means 19 and a non-elastomeric strap means 20. Variable length connector means 18 is releasably connected to strap means 20.

Figure 16:
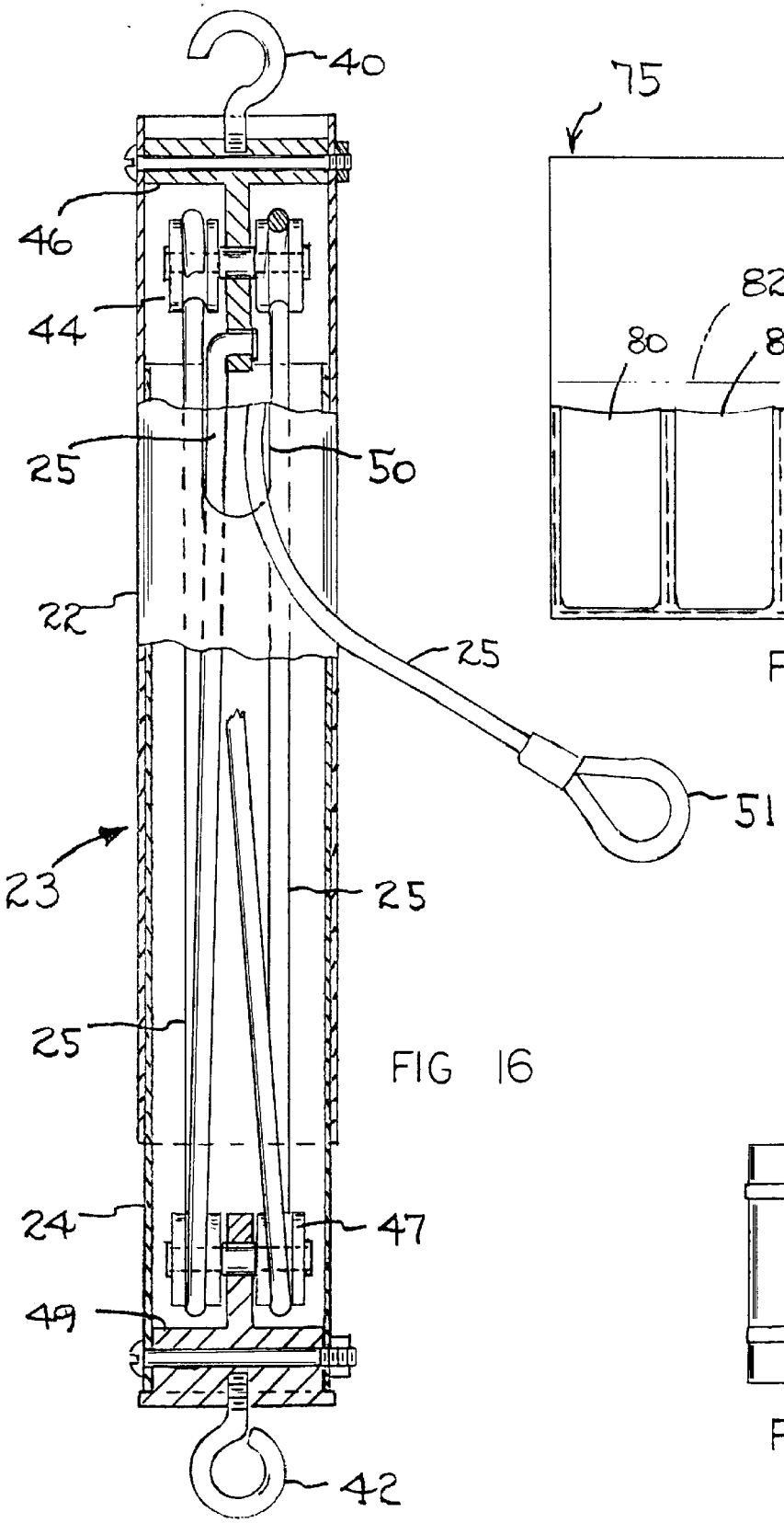
FIG. 16, is a sectional view of a variable length connector means used in the FIG. 1 mechanism. A portion of the FIG. 16 connector is shown in elevation.

Variable length connector means 18 comprises a tube assembly 23 that includes a first tube 22 attachable to anchorage 12 and a second tube 24 attachable to strap means 20. The tubes 22 and 24 are telescopically connected so that the tubes can slide relatively to one another, to vary the length of the tube assembly. A flexible tension element 25 is trained around a pulley system within the tube assembly, as shown in FIG. 16.

An external section of tension element 25 is connected to a handgrip 26, via an adjustable length connector belt 28. When a downward manual force is applied to handgrip 26 the handgrip 26 is moved from the full line position (FIG. 1) toward the dashed line position. The pulley system within tube assembly undergoes a reduction in its overall length, while tension element 25 experiences an external length increase (due to the fact that the pulleys in the pulley system move closer together). The increase in tension element external length is appreciably greater than the reduction in tube assembly 25 length. Elastic resistance means 16 experiences a length increase commensurate with the reduction in length of the tube assembly 23.

When a downward manual pulling force is applied to handgrip 26 the external section of tension element 25 experiences a relatively great increase, whereas elastic resistance means 16 experiences a relatively small length increase (due to the action of the pulleys within tube assembly 23). This feature is advantageous in that the person can experience a relatively gradual change in the pressure exerted on the muscles. The person can pull handgrip 26 downward as far as he feels comfortable, while still experiencing a measurable effect on the arm or back muscles.

As previously indicated, the person can operate the exercise mechanism in the sitting position or the standing position. When the standing position is used, it may not be necessary to employ the connector belt 28 between tension element 25 and handgrip 26. Belt 28 can be removed so that tension element 25 is connected directly to handgrip 26. Alternatively, belt 28 can be left in place between tension element 25 and the handgrip, but shortened in length so as to elevate the handgrip when the tension element is in the starting (non-tensioned) condition.

Figure 3:
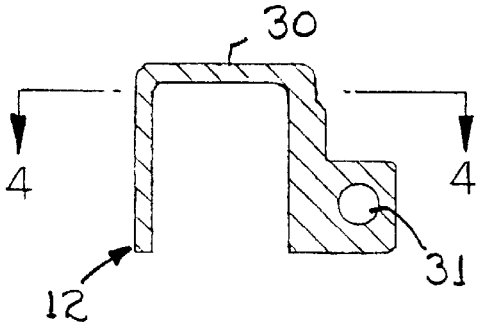
FIG. 3, shows an anchorage used on the upper edge of a room door to mount the FIG. 1 mechanism.
Figure 4:
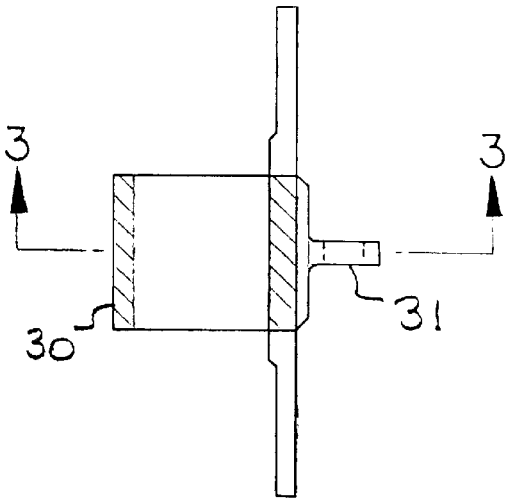
FIG. 4, is a sectional view taken on line 4—4 in FIG. 3.

FIGS. 3 and 4 show an anchorage 12 construction that can be used in practice of the invention. As there shown, the anchorage comprises a channel 30 adapted to grip the upper edge of a door, and a lug having an opening 31 for connecting the anchorage to the exercise mechanism. The channel 30 surfaces can be rubber-coated to prevent scuffing of the door surfaces.

Figure 5:
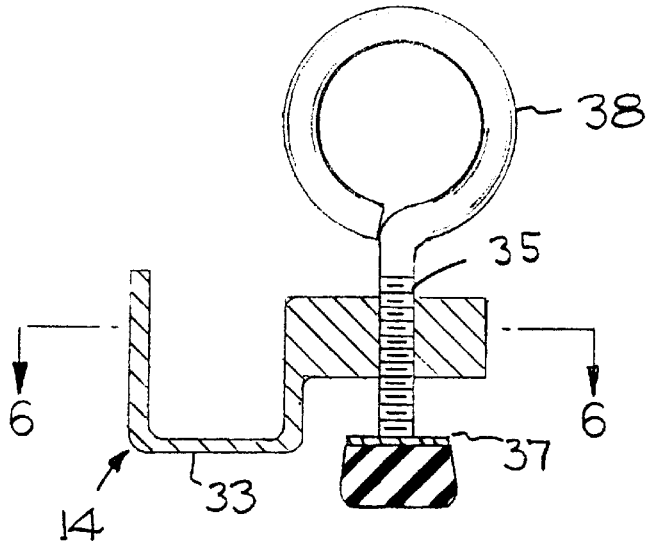
FIG. 5, shows an anchorage used on the lower edge of a room door to mount the FIG. 1 mechanism.
Figure 6:
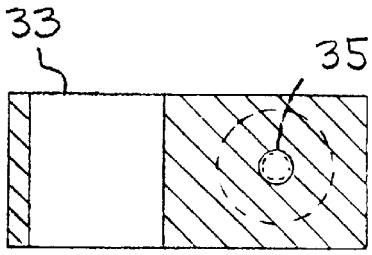
FIG. 6, is a sectional view taken on line 6—6 in FIG. 5.

FIGS. 5 and 6 show an anchorage 14 construction that can be employed. The anchorage comprises a channel 33 and a block portion having a threaded hole for receiving the threaded shank 35 of a foot structure 37. The shank has an eye 38 for connecting the anchorage to the exercise mechanism. The foot structure can be rotated to raise or lower the foot structure, as necessary to stabilize the foot structure relative to the floor surface.

Figure 11:
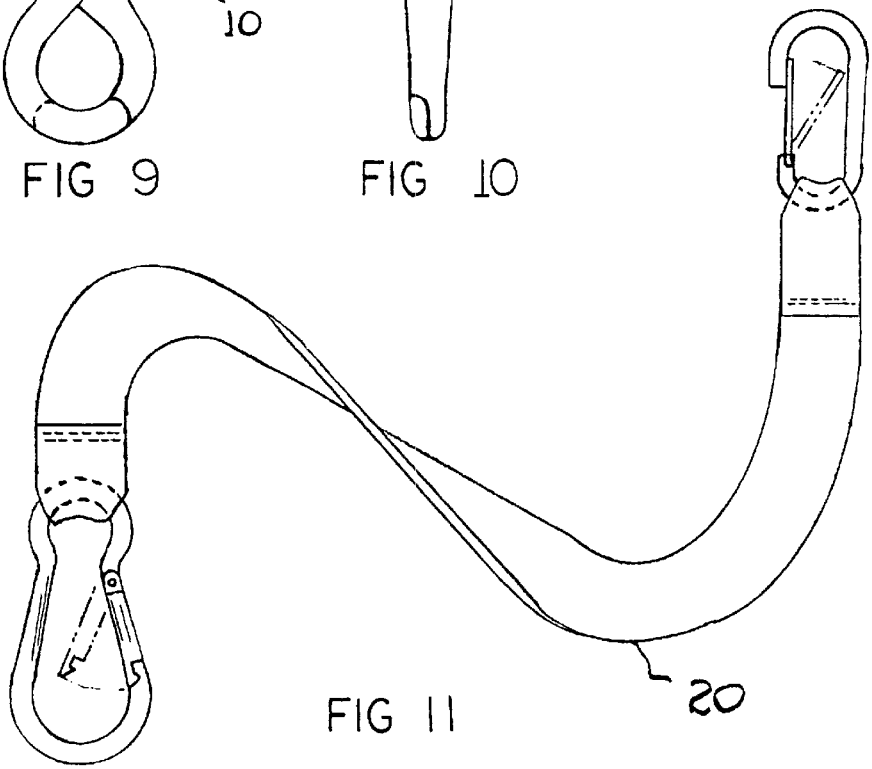
FIG. 11, is an elevational view of a belt structure used in the FIG. 1 mechanism.

FIG. 16 shows a structure that can be used for the tube assembly 23. The tube assembly comprises an outer cylindrical tube 22 and an inner tube 24 slidable with tube 22. An attachment means 40 is suitably affixed to tube 22, and an attachment means 42 is suitably affixed to tube 24. In the FIG. 1 arrangement attachment means 40 is releasably connected to upper anchorage 12, and attachment means 42 is releasably connected to belt 20. A suitable belt construction is shown in FIG. 11.

Referring to FIG. 16, there is shown a pulley system that includes two upper pulleys 44 rotatably mounted on an end fixture 46 within tube 22, and two lower pulleys 47 rotatably mounted on an end fixture 49 within tube 24. A rope 25 has one end anchored to Fixture 46. The rope extends back and forth around the pulleys and out of the tube assembly through an elongated slot 50 in tube 22. The external free end of rope 25 is formed into a loop for releasable connection with the aforementioned connector belt 28 (or in some cases handgrip 26).

Figure 14:
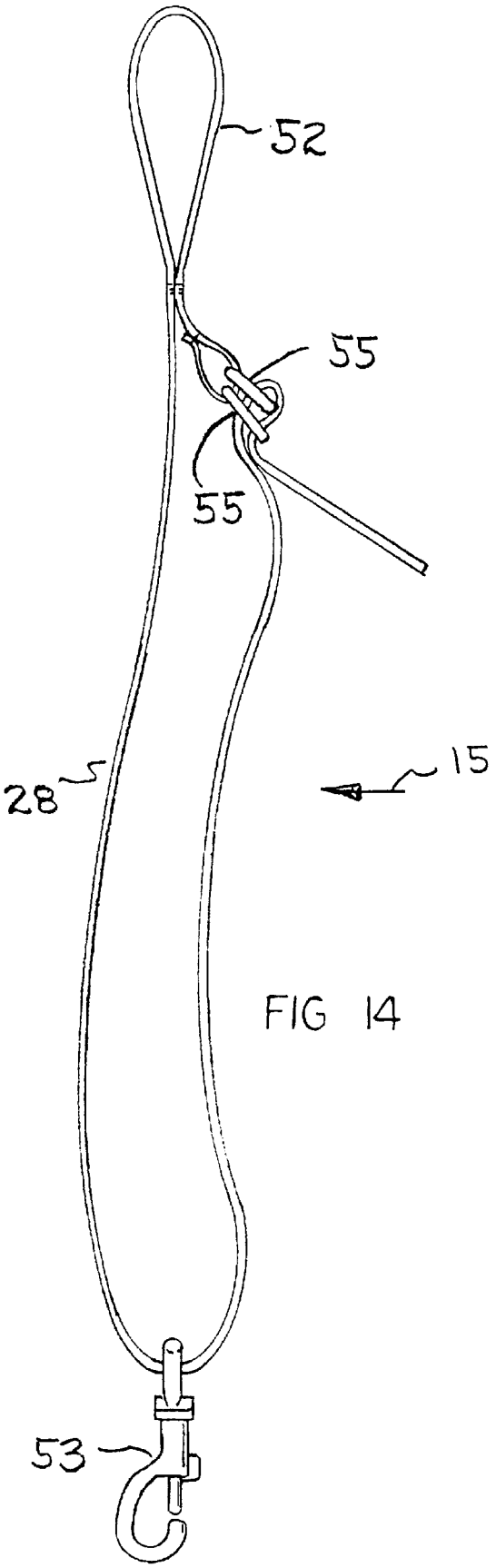
FIG. 14, is a side elevational view of a tension element component used in the FIG. 1 mechanism.
Figure 15:
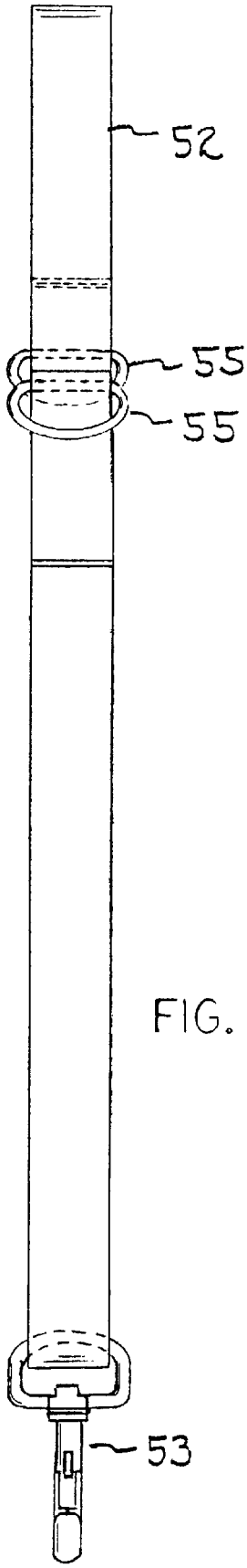
FIG. 15, is a transverse view of the FIG. 14 component, taken in the direction of arrow 15 in FIG. 14.

A suitable construction for connector belt 28 is shown in FIGS. 14 and 15. As there shown, the belt has a loop 52 adapted to connect with a fixture on handgrip 26, and a manually-open buckle 53 adapted to connect with the loop 51 on rope 25. The effective length of belt 28 can be changed by suitable manipulation of friction lock rings 55 that embrace the belt. Various devices can be used to vary the length of connector belt 28.

Figure 12:
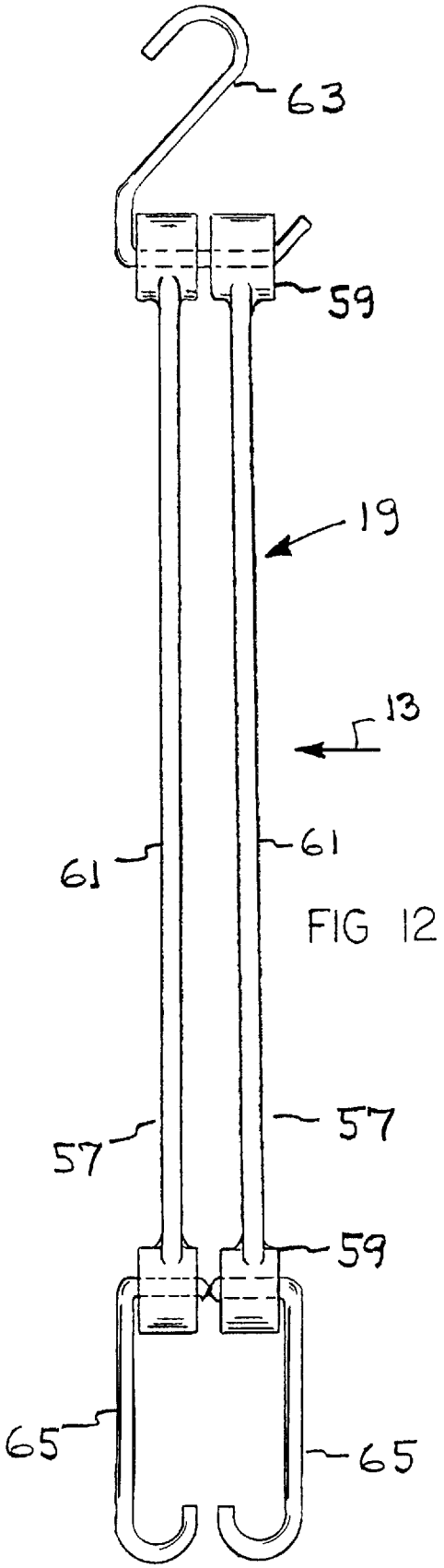
FIG. 12, is an elevational view of an elastic resistance means used in the FIG. 1 mechanism.
Figure 13:
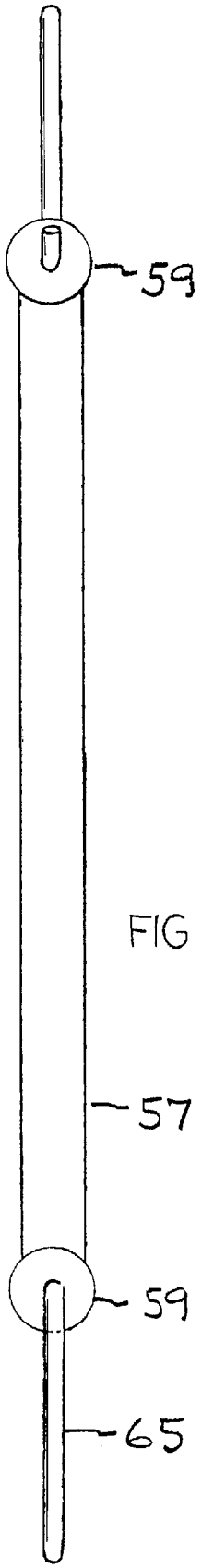
FIG. 13, is a view of the FIG. 12 elastic resistance means, taken in the direction of arrow 13 in FIG. 12.

Elastic resistance strap 19 can be constructed as shown in FIGS. 12 and 13. FIG. 12 shows two elastomeric strap elements 57 having integral enlarged cylindrical end sections 59. The main section 61 of each elastomeric strap element has a rectangular cross section that is less than that of each end section 59, so that elastic deformation of each strap element is confined to the elongated main section 59. Suitable attachment devices 63 and 65 are provided at the end sections 59 of the elastomeric strap elements for operatively attaching said strap elements to other components in the exercise mechanism. The number of elastomeric strap elements 57 used in any given instance can be varied, depending on the resistance that is desired. If desired, coil springs can be used in lieu of the elastomeric strap elements.

Figure 7:
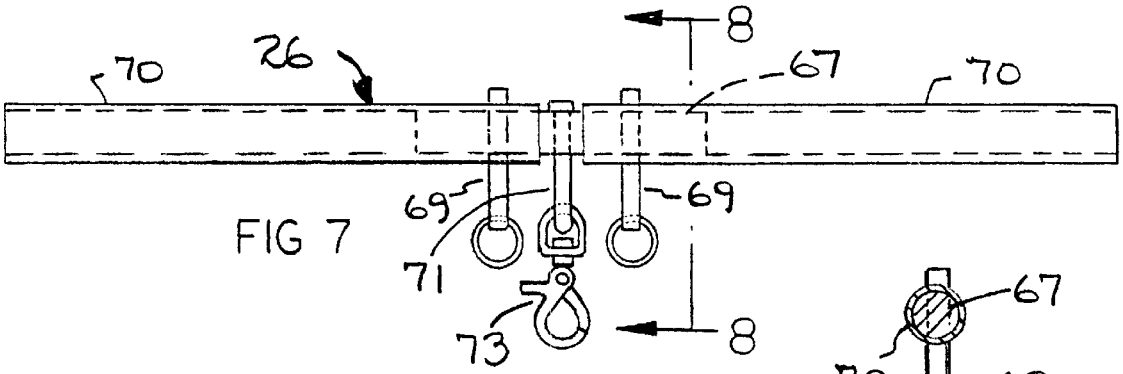
FIG. 7, is an elevational view of a handgrip used in the FIG. 1 mechanism.
Figure 8:
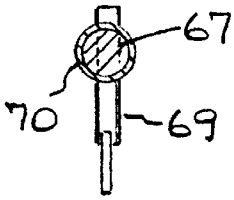
FIG. 8, is a transverse sectional view taken on line 8—8 in FIG. 7.

FIGS. 7 through 10 show a handgrip 26 construction that can be used. As shown in FIG. 7, the handgrip comprises a central cylindrical rod 67 having detachable connection 69 with overlapping tubes 70. Each tube 70 can be gripped by one hand of the user (i.e. the person uses two hands to exert a pulling action on the handgrip).

Figure 9:
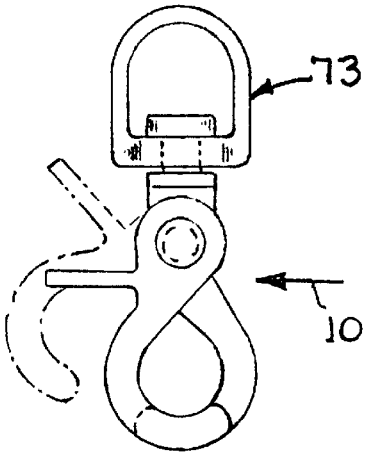
FIG. 9, is an enlarged view of a structural component used on the FIG. 7 handgrip.
Figure 10:
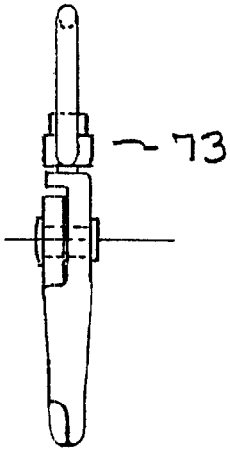
FIG. 10, is an edge view of the FIG. 9 component, taken in the direction of arrow 10 in FIG. 9.

An eye bolt 71 extends from rod 67 to mount a swivel connector 73. As shown in FIG. 9, the swivel connector can be manually opened to attach the connector to an operating component in the exercise mechanism, e.g. loop 52 of adjustable length belt 28.

Figure 2:
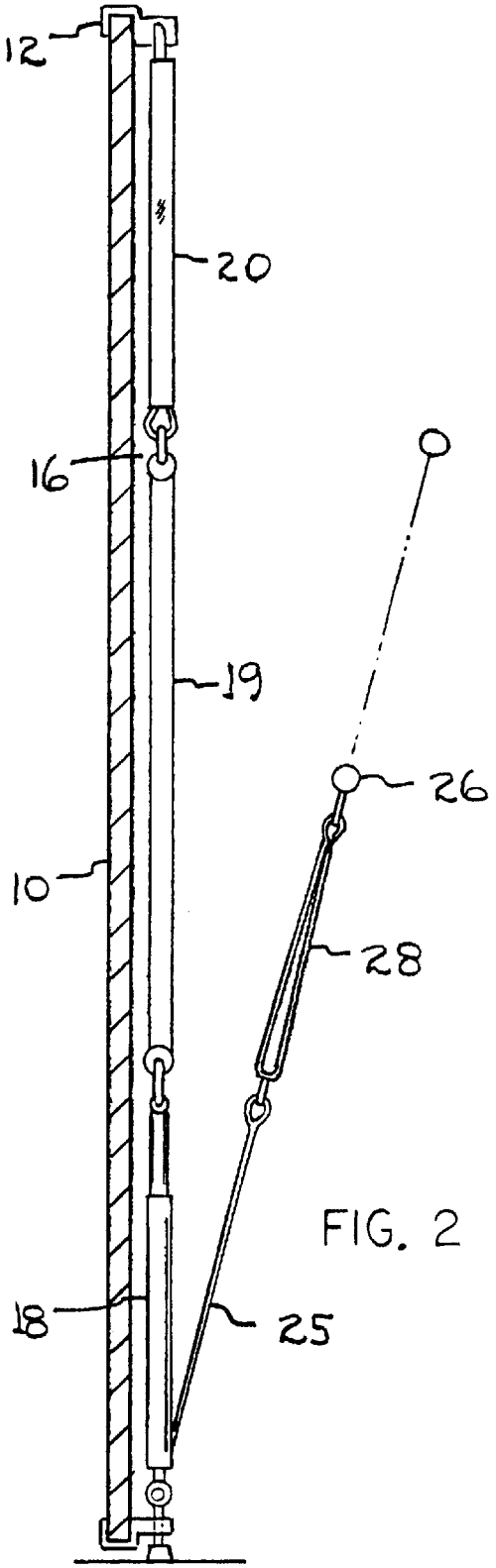
FIG. 2, shows the exercise mechanism of FIG. 1 installed in a reverse orientation on the room door, i.e. with the elastic resistance means located so that the person using the mechanism is required to exert an upward pulling force in order to exercise his/her muscles. In the FIG. 1 orientation the person is required to exert a downward pulling force in order to exert his/her muscles.

FIG. 1 shows one orientation of the components in the exercise mechanism, adapted to exercise the person's arm or back muscles by offering an elastic resistance to a manual downward force on handgrip 26. FIG. 2 shows a second orientation that can be used to provide an elastic resistance to a manual upward force on handgrip 26.

As shown in FIG. 2, the variable length connector means 18 (tube assembly 23) is attached to the lower anchorage 14. The elastomeric resistance means 16 (elastomeric strap 19 and non-elastic strap 20) is attached to upper anchorage 12. With the FIG. 2 arrangement, the person exercises his arm or back muscles by exerting an upward pulling force on handgrip 26.

The same mechanism can be used for either exercise regimen, i.e. the downward pulling motion of FIG. 1 or the upward pulling motion of FIG. 2.

Figure 17:
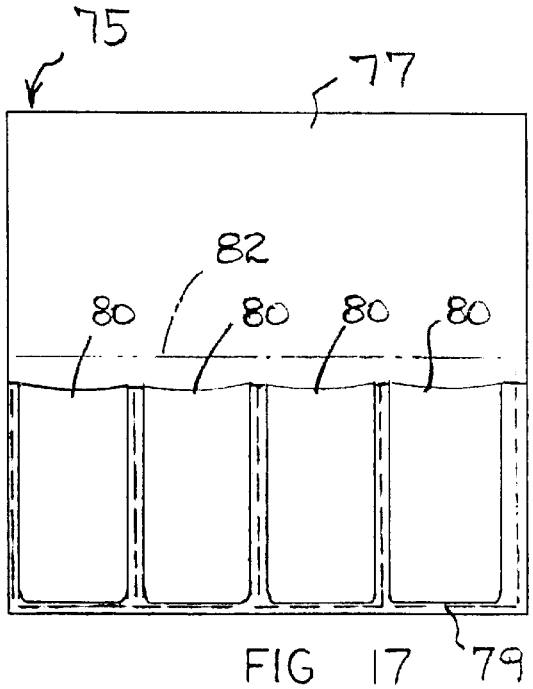
FIG. 17, is a view of a flexible pouch used to contain the componentry of FIGS. 3 through 16 when the componentry is in a disassembled condition.
Figure 18:
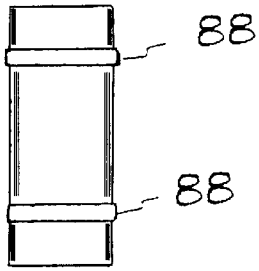
FIG. 18, is a view of the FIG. 17 pouch, with the pouch in a rolled-up condition suitable for transport or storage of the mechanism components.

One advantage of the illustrated mechanism is that the room door 10 serves as a mounting means for the mechanism. The operating components can be individually very light weight and relatively easily disconnected or broken down into small size structures. FIGS. 17 and 18 show a fabric pouch structure 75 that can be used to contain the components after they have been disassembled.

As shown in FIG. 17 the pouch structure comprises a first rectangular fabric panel 77 and a second smaller rectangular panel 79 stitched to panel 77 along predetermined lines so as to form a series of open pockets 80. The dissassembled operating components of the exercise mechanism can be inserted into different ones of pockets 80, after which panel 77 can be folded along fold line 82 to prevent the components from falling out of the pockets.

The folded pouch can be rolled into a generally cylindrical package and secured against separation by external straps 84, as shown in FIG. 18. The final package has a relatively small volumetric displacement, so as to be easily stored, e.g. on a closet shelf or in a drawer.

However, it will be appreciated by those skilled in the arts pertaining thereto, that the present invention can be practiced in various alternate forms, proportions, and configurations. Further, the previous detailed description of the preferred embodiment of the present invention are presented for purposes of clarity of understanding only, and no unnecessary limitations should be implied therefrom. Finally, all appropriate mechanical and functional equivalents to the above, which may be obvious to those skilled in the arts pertaining thereto, are considered to be encompassed within the claims of the present invention.

What is claimed is:

1. An exercise mechanism comprising:

first and second anchorages;

an elastic resistance means extending from said first anchorage;

a variable length connector means extending between said second anchorage and said elastic resistance means; and said variable length connector means comprising an elongated housing, a flexible tension element extending from said housing at a point near said second anchorage, and a handgrip carried by the external end of said tension element, whereby a manual pulling force on said handgrip reduces the length of said housing while applying an operating force to said elastic resistance means.

2. The exercise mechanism, as described in claim 1, wherein said variable length connector means comprises a pulley system located within said elongated housing, said flexible tension element being trained around said pulley system so that the tension element experiences an increase in its external length while the housing is experiencing a reduction in its length.

3. The exercise mechanism, as described in claim 2, wherein said pulley system has four pulleys.

4. The exercise mechanism, as described in claim 2, wherein said variable length housing comprises first and second telescoping tubes, said first tube being connected to said second anchorage; said second tube being connected to said elastic resistance means; said pulley system comprising two pulleys mounted on said first tube and two pulleys mounted on said second tube.

5. The exercise mechanism, as described in claim 2, wherein said variable length housing comprises first and second tubes telescoped one within the other; said first tube being connected to said second anchorage; said second tube being connected to said elastic resistance means; said pulley system comprising at least on pulley located within said first tube, and at least one pulley located within said second tube.

6. The exercise mechanism, as described in claim 1, wherein said first anchorage has a detachable connection with said elastic resistance means, and said second anchorage has a detachable connection with said variable length connector means; said variable length connector means having a detachable connection with said elastic resistance means, whereby the exercise mechanism can be broken down for easy transport and storage.

7. The exercise mechanism, as described in claim 1, wherein said elastic resistance means comprises at least one elongated elastomeric strap; each said elatromeric strap having an elongated main section and two end sections, each main section having a constant cross section, each end section being enlarged relative to the main section so that elastic deformation is confined to the elongated main section.

8. The exercise mechanism, as described in claim 7, wherein the main section of each elastomeric strap has a rectangular cross section.

9. The exercise mechanism, as described in claim 1, wherein said first anchorage comprises means for attachment to one edge of a door, and said second anchorage comprises means for attachment to another edge of a door, whereby the exercise mechanism is adapted to extend along one face of the door.

10. The exercise mechanism, as described in claim 1, wherein said first anchorage comprises a first channel adapted to fit on one edge of a door, and said second anchorage comprises a second channel adapted to fit on another edge of a door, whereby the exercise mechanism is adapted to extend along one face of the door.

11. An exercise mechanism comprising:

First and second anchorages; said first anchorage being adapted to fit on an upper edge of a room door; said second anchorage being adapted to fit on a lower edge of the room door;

an elastic resistance means connectable alternatively to said first anchorage or said second anchorage;

a variable length connector means extendable between said elastic resistance means and either one of said anchorages, depending on the location of said resistance means on the room door;

said variable length connector means comprising a tube assembly that includes two tubes slidably telescoped one within the other; a pulley system that includes a first set of pulleys located within one of said tubes, and a second set of pulleys located within the other tube;

a flexible tension element trained around the pulleys in said first and second pulley sets, said tension element extending out of one of the tubes; and a handgrip carried by the external end of said tension element, whereby a manual pulling force on said handgrip produces a decrease in the tube assembly length and an increase in the external length of the tension element.

12. The exercise mechanism of claim 11, wherein the increase in the external length of the tension element is appreciably greater that the decrease in the tube assembly length, in accordance with the number of pulleys in the pulley system.

13. The exercise mechanism of claim 11, wherein the external length of the tension element is adjustable when the tension element is in the non-tensioned state.

* * * * *